United States Patent [19]

Turbak et al.

[11] 4,405,549

[45] Sep. 20, 1983

[54] ZINC-FREE PREPARATION OF RAYON FIBERS

[75] Inventors: Albin F. Turbak, Convent Station; Peter J. Hartmann, Dover, both of N.J.

[73] Assignee: International Telephone and Telegraph Corporation, New York, N.Y.

[21] Appl. No.: 283,070

[22] Filed: Jul. 13, 1981

[51] Int. Cl.[3] ..... D01F 2/06

[52] U.S. Cl. ..... 264/188; 264/197

[58] Field of Search ..... 264/188–197

[56] References Cited

U.S. PATENT DOCUMENTS

| | | | |
|---|---|---|---|
| 1,930,803 | 10/1933 | Harrison | 264/197 |
| 2,997,365 | 8/1961 | Smith et al. | 264/197 |
| 3,097,914 | 7/1963 | Lewis | 264/196 |
| 3,720,743 | 3/1977 | Stevens et al. . | |
| 4,242,405 | 12/1980 | Bockno | 264/188 |

*Primary Examiner*—Jay H. Woo

*Attorney, Agent, or Firm*—James B. Raden; Harold J. Holt

[57] ABSTRACT

Rayon fibers having high wet modulus, low wet elongation and low caustic solubility are prepared from an unmodified viscose spinning solution by spinning the viscose solution into a zinc-free coagulation bath containing at least 125 g/l of $Na_2SO_4$, at least 125 g/l of $(NH_4)_2SO_4$ and less than 100 g/l of $H_2SO_4$ while the bath is at a temperature above 40° C. The coagulated filament is then stretched in a secondary bath maintained at a temperature over 70° C.

6 Claims, No Drawings

ZINC-FREE PREPARATION OF RAYON FIBERS

This invention relates to a process for the zinc-free preparation of rayon fibers and to the fibers prepared therefrom.

Essentially all rayon yarns and staple fibers produced commercially today are produced by the viscose process which requires the use of zinc salts in the coagulation/regeneration bath in order to produce rayon fibers having acceptable physical properties. Because of the large volumes of water that are employed in viscose production, great difficulty is encountered in purifying the effluent from viscose plants and zinc has proven to be a particularly intractable pollution control problem. It is, therefore, essential to the rayon industry that a method be found to prepare quality rayon fiber without the need of zinc containing coagulation baths.

Zinc salts are used in coagulation baths to extend the time of regeneration. A typical viscose solution contains many times as much water as cellulose. It is necessary to squeeze out by "syneresis" most of this excess water and densify the cellulose. Initially, the spinning of rayon did not involve the use of zinc. Viscose was spun into a system referred to as a "Muller bath" which consisted of a mixture of sodium sulfate and ammonium sulfate. The coagulated dope was then run into a second bath which contained 12–15% sulfuric acid to give the xanthate decomposition and concomittant regeneration to rayon. In this two bath process the rayon had a chance to re-swell in the second acid bath before it was regenerated and as a result this produced a fiber which did not have exceptional properties.

Subsequently, viscose was spun into a bath containing only sodium sulfate and 12–15% sulfuric acid and this gave somewhat improved rayon fibers. In this case the coagulation and regeneration were occurring simultaneously in one bath and this represented the standard viscose spinning process for many years.

The industry then began to appreciate that such baths were not producing optimum fiber properties since regeneration was taking place at a far greater rate than coagulation and basically was producing a fiber that was not as completely densified as it should be prior to final regeneration. In essence, the rapid regeneration was producing a swollen or "foamed" fiber.

It then became clear that the excess water in the viscose had to be removed while the viscose had a sufficient number of xanthate groups to remain plastic enough to compact. This realization led to attempts to slow down regeneration so that more coagulation could occur before the ultimate fiber was produced. Ultimately it was found that if certain types of amines and polyethylene glycols were added to the viscose and zinc salts to the acid coagulation bath, the time during which the fiber remained plastic was greatly extended and this permitted better densification and improved stretch. Such additives were finally adopted by the industry for manufacturing fibers having the optimum combination of wet modulus and strength properties. The major effort has thus been to slow down fiber regeneration rather than to significantly improve coagulation and densification rates.

In the manufacture of reinforced sausage casings, thick viscose films (up to 30 mils in thickness) are laid onto a fibrous paper web. This paper-viscose matrix is paseed into a coagulation bath at room temperature containing sodium sulfate, ammonium sulfate and sulfuric acid. In order to properly obtain densification of the viscose, a high concentration of total salt is employed along with a low concentration of acid. While this system has been used for making saturated reinforced paper for sausage casings, in so far as is known, it has never been considered applicable to rayon fiber manufacture.

A primary object of this invention is to provide a process for producing rayon fibers having excellent properties, which process does not utilize zinc compounds of any kind.

It is an additional object of this invention to provide rayon fibers of unusually low caustic solubility combined with high wet modulus and low wet elongation properties.

It is still an additional object of this invention to provide a process for producing rayon fibers which utilizes chemicals which are totally recoverable by known techniques and thus presents considerably reduced environmental problems.

The foregoing and other objects of this invention are achieved by preparing an unmodified viscose spinning solution from cellulose having a degree of polymerization of less than 600, the solution having a salt index of from 2.5 to 10 and spinning the viscose solution into a zinc-free coagulation bath comprising at least 125 grams/liter of $Na_2SO_4$, at least 125 grams/liter of $(NH_4)_2SO_4$ and from about 25 to 100 grams/liter of $H_2SO_4$ while the bath is at a temperature from about 40° to 100° C. The resulting coagulated filament is then stretched in a secondary bath while the secondary bath is at a temperature from about 70° to 100° C.

Ammonium sulfate has a water solubility of 440 g/l while a sodium sulfate solution is saturated at 280 g/l at 25° C. Thus, ammonium sulfate baths of high concentration are extremely good dehydrating agents and will remove water from any source, such as viscose dope. By the use of the foregoing selected salt mixture, low acid level and the required temperatures, we have been able to exert control of viscose coagulation relative to regeneration so as to be able to obtain highly densified rayon fibers having high wet modulus, low wet elongation and exceptionally low $S_{6.5}$ values without the use of either viscose additives or zinc salts in the coagulation bath. The fibers have wet modulus values of over 0.4 grams/denier, wet elongations of less than 15% and solubility in 6.5% caustic ($S_{6.5}$) values of less than 9%.

The unique control which we are capable of exerting on the spinning process is evidenced by the resulting fiber properties. $S_{6.5}$ or solubility in caustic values are an important fiber property because they are a measure of the fibers resistance to laundering and thus of washing performance. By the process of the invention, it is possible to produce a fiber having an $S_{6.5}$ value as low as 3–5% while regular rayon fibers are normally 20–30% and high wet modulus fibers are normally at 8–12%. The only fibers produced previously with such a low $S_{6.5}$ value were those cross-linked with formaldehyde or other similar cross-linking agent. The reason that the fibers of the invention have such a low extractability in 6.5% caustic is believed to be that they are thoroughly coagulated and densified throughout before being regenerated. In contrast, known systems for making rayon form tough outer skins and leave highly amorphous interiors which later are readily removed by the 6.5% caustic. Even when zinc is employed to retard the skin formation, it does not do as good a job as the controlled bath of the invention since even the zinc bath fibers have a higher $S_{6.5}$ value than the present fibers.

Additional evidence for the unique control we exert on the coagulation/regeneration rate is found in the cross-sectional shape of the fibers. Regular rayon forms a dense skin with a "jelly-like" interior and then when this "jelly-like" amorphous interior subsequently densifies, the skin assumes a very irregular serrated configuration to comply with the shrunken gel mass. In contrast, the present fibers appear like large kidney beans in cross-section showing that most of the internal part of the fibers is essentially as coagulated as any exterior or surface part. Further, the present fibers do not display any pronounced skin/core effect as is the case with most rayons.

An additional important observation which further attests to the unique nature of the present process deals with the relationship of viscose salt index, process stretch and fiber modulus. Present viscose technology teaches that in order to make a high wet modulus rayon, it is necessary to use a "green" viscose with a high salt index and to stretch extensively, usually above 100% stretch. In contrast, we have found that to obtain the best wet modulus, it is necessary with the coagulation bath of the invention to use low salt index viscose and we have further found that wet modulus is not a function of stretch, since the present process obtains a wet modulus of 0.4 or more with less than about 100% and usually less than 80% stretch.

The salt index should be less than 10, preferably between 3 and 7. The economic significance of using a low salt index is noteworthy. This means that a lean viscose with low NaOH, low $CS_2$ and high cellulose content can be used to obtain good wet modulus fibers. This is the opposite of current practice and indicates that densification of dope, not stretch, controls wet modulus. Stretch is apparently more closely related to fiber strength.

If the acid concentration in the present process is raised to levels above 10% (100 g/l or about 2 normal), it has been found that the kidney-beaned crossectional shape disappears and fibers with significantly different properties are obtained. (Such other fibers and their preparation are the subject of our copending application Ser. No. 283,069 filed concurrently herewith.) The acid concentration should accordingly be kept below about 100 g/l, preferably between 40–80 g/l, to allow for more complete coagulation and to avoid being overcome by too rapid a rate of regeneration. It is also preferable that the concentration of $Na_2SO_4$ be from 130 to 170 g/l and the concentration $(NH_4)_2SO_4$ be from 200 to 275 g/l.

The invention will be better understood from the following examples in which all parts and percentages are by weight, unless otherwise indicated. Throughout these examples, the pulp and NaOH are based on total composition weight, $CS_2$ is based on cellulose weight.

EXAMPLE 1

A viscose composition was prepared from 7.5% prehydrolyzed kraft cellulosic pulp, 7.5% NaOH and 30% $CS_2$. The viscose was mixed for two hours, filtered, vacuum deaerated and ripened for about 20 hours at ambient temperature. No modifiers of any type were added. The salt index was 8.8 at the time of spin. The viscose solution was then spun through an 1100 hole spinnerette having a hole size of 63.5 microns, employing the following conditions:

| | Primary Bath | Secondary Bath |
|---|---|---|
| $H_2SO_4$ (g/l) | 50 | 50 |
| $Na_2SO_4$ (g/l) | 150 | 150 |
| $(NH_4)_2SO_4$ (g/l) | 250 | 250 |
| Temperature (°C.) | 40–50 | 96 |
| Travel (m) | 0.69 | 0.74 |

Take-up speed of the fiber on the godet was 30 m/min. Stretch was 82%. Approximately 5 grams of fiber was collected on the take-up godet, removed, cut to staple length, washed with hot tap water and squeezed by hand. The fiber was then soaked in acetone for ten minutes, squeezed by hand and allowed to air dry in a fume hood overnight. Fiber properties were then measured.

EXAMPLE 2

Example 1 was repeated but the spinning solution had a salt index of 14 (because extra $CS_2$ was added) rather than 8.8. The fiber properties of Examples 1 and 2 were as follows:

| | Example 1 | Example 2 |
|---|---|---|
| Conditioned Tenacity (g/d) | 2.31 | 2.10 |
| Conditioned Elongation (%) | 8.16 | 10.25 |
| Wet Tenacity (g/d) | 1.45 | 1.34 |
| Wet Elongation (%) | 9.98 | 13.65 |
| Wet Modulus (g/d) | 0.46 | 0.21 |
| $S_{6.5}$ (%) | 8.5 | 15.1 |

EXAMPLE 3

Fibers were prepared as set forth in Example 1 using a viscose composition containing 7.58% prehydrolyzed kraft pulp, 7.52% NaOH and 30% $CS_2$. The salt index was 5.8. The viscose solution was then spun through an 1100 hole spinnerette having a hole size of 63.5 microns, employing the following conditions:

| | Primary Bath | Secondary Bath |
|---|---|---|
| $H_2SO_4$ (g/l) | 36 | 36 |
| $Na_2SO_4$ (g/l) | 150 | 150 |
| $(NH_4)_2SO_4$ (g/l) | 250 | 250 |
| Temperature (°C.) | 62 | 78 |
| Travel (m) | 0.69 | .74. |

Take-up speed was 30 m/min. Stretch was 78%. Approximately 5 grams of fiber were collected on the take-up godet, removed, cut to staple length and processed as follows: The fiber was soaked in 0.25% $H_2SO_4$ at 85% C. for 3 minutes, rinsed in cold tap water, soaked in 5 g/l sodium sulfide at 40° C. for 3 minutes, rinsed in cold tap water, soaked in 0.25% $H_2SO_4$ at 40° C. for 3 minutes, rinsed in cold tap water and dried at 88° C. for about 16 hours.

EXAMPLE 4

Example 3 was repeated except that the viscose composition contained 7.55% prehydrolyzed kraft pulp, 7.55% NaOH and 30% $CS_2$. The salt index of the viscose solution was 2.5 and stretch was 80%. All other conditions were identical to Example 3. Properties of the fibers of Examples 3 and 4 were as follows:

| | Example 3 | Example 4 |
|---|---|---|
| Conditioned Tenacity (g/d) | 2.79 | 1.92 |
| Conditioned Elongation (%) | 10.35 | 5.45 |
| Wet Tenacity (g/d) | 1.49 | 1.13 |
| Wet Elongation (%) | 12.25 | 7.45 |
| Wet Modulus (g/d) | 0.42 | 0.71 |
| $S_{6.5}$ (%) | 3.5 | 4.0 |

Examples 1–4 illustrate that surprisingly, the highest wet modulus fibers resulted from the lowest salt index viscoses. This is opposite the findings of other viscose systems and is significant economically because low $CS_2$ levels can be used with the present process to make high wet modulus fibers. In addition, caustic solubility values decline with declining salt index. Specifically, Table I summarizes in order of decreasing salt indices, the wet modulus and $S_{6.5}$ values for Examples 1–4.

TABLE I

| Example | Salt Index | Wet Modulus (g/d) | $S_{6.5}$ |
|---|---|---|---|
| 2 | 14 | 0.21 | 15.1 |
| 1 | 8.8 | 0.40 | 8.5 |
| 3 | 5.8 | 0.42 | 3.5 |
| 4 | 2.5 | 0.71 | 4.0 |

EXAMPLE 5

Example 1 was repeated varying essentially only the salt index of the viscose solution and the acid concentration of the coagulation bath. The salt index was 8.8 and the acid concentration was 113 g/l.

EXAMPLE 6

Example 3 was repeated using, however, a viscose solution containing 7.55% pulp, 7.55% NaOH and 30% $CS_2$ having a salt index of 2.5. The acid concentration of the coagulant bath was 73 g/l. Stretch was 66%. Other parameters were essentially those of Example 3.

Table II summarizes, in order of increasing acid concentration, the wet modulus and caustic solubility values of Examples 1–6 in accordance with the salt indices of the examples. (A solution having an acid concentration of 49 g/l is equivalent to a one normal solution.)

TABLE II

| Example | Acid Concentration (g/l) | Wet Modulus g/d ($S_{6.5}$%) at Salt Index 14.0 | 8.8 | 5.8–6.0 | 2.5 |
|---|---|---|---|---|---|
| 4 | 36 | | | | 0.71(4.0) |
| 3 | 36 | | | 0.42(3.5) | |
| 1 | 50 | | 0.46(8.5) | | |
| 2 | 50 | 0.21(15.0) | | | |
| 6 | 73 | | | | 0.40(3.8) |
| 5 | 113 | | 0.25(9.9) | | |

An examination of Table II illustrates that, within a given salt index, the wet modulus was lower as the acid concentration increased and higher as the salt index went down. These results are the opposite of conventional viscose practice and regular rayon production which normally uses more than 100 g/l of acid and rarely uses salt indices as low as 2.5.

EXAMPLES 7–9

The following three examples illustrate the effect of bath temperature on wet modulus and caustic solubility properties of the fibers. In Examples 7 and 8, fibers were prepared from a viscose composition containing 7.5% prehydrolyzed kraft pulp, 7.5% NaOH and 30% $CS_2$ to which had been added 4 ml of $CS_2$/l of viscose. The viscose composition had a salt index of 14. The primary and secondary baths had 55 g/l of $H_2SO_4$, 150 g/l of $Na_{SO4}$ and 250 g/l of $(NH_4)_2$ $SO_4$. Bath temperatures were as set forth in Table III. Take-up speed was 30 m/min. Stretch was 64%. In Example 9, fibers were prepared substantially as set forth in Example 4, except that bath temperatures were adjusted to the values set forth in Table III. For comparison, Example 4 results are also included in the Table.

TABLE III

| Example | Bath Temp. °C. Primary | Secondary | Wet Modulus g/d ($S_{6.5}$%) at Salt Index 6.0 | 2.5 |
|---|---|---|---|---|
| 7 | 22 | 23 | 0.23 (13.1) | |
| 8 | 40 | 78 | 0.48 (7.5) | |
| 9 | 40 | 71 | | 0.53 (5.2) |
| 4 | 62 | 78 | | 0.71 (4.0) |

It will be noted that the modulus goes up and the caustic solubility ($S_{6.5}$) goes down as the temperature of the primary and secondary baths are raised. It will also be noted that the physical property values are more sensitive to temperatures at the higher salt index.

EXAMPLE 10

Fibers were prepared from the same viscose composition as Example 1, except that the salt index was lowered to 2.5 by the addition of 4% $Na_2CO_3$. The primary and secondary baths were the same as Example 1, except that bath temperatures were 40° and 98° C. for primary and secondary baths respectively. No stretch was applied to the fibers. The fibers had a wet modulus of 0.50 g/d indicating that neither high stretch, nor even stretch at all, was necessary to obtain high wet modulus. The $S_{6.5}$ value was 7.1%. The strength properties would have been improved by stretch, but not the wet modulus. Conventional high wet modulus fibers are normally processed at over 100% stretch.

EXAMPLE 11

Fibers were prepared from a "lean" viscose solution, i.e. containing 8.9% cellulose, 6% NaOH and 28% $CS_2$. The salt index was 4.8. Bath compositions of both primary and secondary baths were 36 g/l of $H_2SO_4$, 150 g/l of $Na_2SO_4$ and 250 g/l of $(NH_4)_2$ $SO_4$. The primary bath temperature was 42° C.; a secondary bath temperature was 72° C. Stretch was 73%.

EXAMPLE 12

Example 11 was repeated except that the bath compositions contained 73 g/l of acid, primary bath temperature was 41° C. and secondary bath temperature was 98° C. Stretch was 68%. The properties of the fibers of Examples 11 and 12 are set forth below:

| | Example 11 | Example 12 |
|---|---|---|
| Conditioned Tenacity (g/d) | 2.61 | 2.43 |
| Conditioned Elongation (%) | 8.68 | 7.96 |
| Wet Tenacity (g/d) | 1.42 | 1.23 |
| Wet Elongation (%) | 10.71 | 10.02 |
| Wet Modulus (g/d) | 0.52 | 0.48 |
| $S_{6.5}$ (%) | 4.6 | 5.3 |

Examples 11 and 12 illustrate that good modulus and $S_{6.5}$ values can be achieved with very lean viscose compositions.

The process of the invention thus produces high wet modulus rayon fibers without the use of zinc additives in the spin bath. The additional sulfate salts used are totally recoverable by standard fractional crystallization methods in which the sodium sulfate is fractionally crystallized from the ammonium sulfate and the ammonium sulfate/sulfuric acid liquor is recycled back to the process. The remaining operational parameters of the process are readily within the scope of present viscose equipment.

We claim:

1. A process for preparing rayon fibers having a wet modulus of more than 0.4 g/den., a wet elongation of less than 15% and a solubility in 6.5% caustic of less than 9% comprising preparing an unmodified viscose spinning solution from cellulose having a degree of polymerization of less than 600, said solution having a salt index of from 3 to 7, spinning said viscose solution into a zinc-free coagulation bath comprising at least 125 g/l of $Na_2SO_4$, at least 125 g/l of $(NH_4)_2SO_4$ and from about 25 to 100 g/l of $H_2SO_4$ while said bath is at a temperature from about 40° to 100° C. and stretching the resulting coagulated filament in a secondary bath while said secondary bath is at a temperature from about 70° to 100° C.

2. The process of claim 1 in which the secondary bath has the same composition as the first bath.

3. The process of claim 1 in which the amount of $Na_2SO_4$ is from 130 to 170 g/l.

4. The process of claim 1 in which the amount of $(NH_4)_2SO_4$ is from 200 to 275 g/l.

5. The process of claim 1 in which the amount of sulfuric acid is from 40–80 g/l.

6. The process of claim 1 in which the coagulated filament is stretched less than 100% in said secondary bath.

* * * * *